US010399640B2

(12) United States Patent
McGarian

(10) Patent No.: US 10,399,640 B2
(45) Date of Patent: Sep. 3, 2019

(54) SECURITY DEVICE

(71) Applicant: Bruce McGarian, Stonehaven (GB)

(72) Inventor: Bruce McGarian, Stonehaven (GB)

( * ) Notice: Subject to any disclaimer, the term of this patent is extended or adjusted under 35 U.S.C. 154(b) by 0 days.

(21) Appl. No.: 15/538,961

(22) PCT Filed: Dec. 14, 2015

(86) PCT No.: PCT/GB2015/053989

§ 371 (c)(1),
(2) Date: Jun. 22, 2017

(87) PCT Pub. No.: WO2016/102929

PCT Pub. Date: Jun. 30, 2016

(65) Prior Publication Data

US 2017/0369129 A1 Dec. 28, 2017

(51) Int. Cl.

| | |
|---|---|
| ***B63B 17/04*** | (2006.01) |
| ***B63G 13/00*** | (2006.01) |
| ***F41H 11/08*** | (2006.01) |
| ***E04H 17/00*** | (2006.01) |

(52) U.S. Cl.

CPC ..... *B63B 17/04* (2013.01); *B63G 13/00* (2013.01); *E04H 17/003* (2013.01); *F41H 11/08* (2013.01); *B63B 2017/045* (2013.01)

(58) Field of Classification Search

CPC ... B63B 17/04; B63B 2017/045; B63B 45/08; F41H 11/08; B63G 13/00; E04H 17/00

USPC ..... 114/361, 364

See application file for complete search history.

(56) References Cited

U.S. PATENT DOCUMENTS

2010/0101471 A1* 4/2010 van Krieken ..... B63B 1/04 114/39.25

FOREIGN PATENT DOCUMENTS

| | | | | |
|---|---|---|---|---|
| AU | 2006235859 A1 | | 5/2008 | |
| CN | 201350963 Y | * | 11/2009 | ..... B63B 17/04 |
| CN | 201472648 U | | 5/2010 | |
| CN | 202935562 U | | 5/2013 | |
| GB | 1341017 A | | 12/1973 | |
| WO | 2013072704 A1 | | 5/2013 | |
| WO | 2016102929 A1 | | 6/2016 | |

OTHER PUBLICATIONS

International Search Report and Written Opinion dated Jun. 30, 2016 in International Patent Application No. PCT/GB2015/053989, 10 pages.

International Preliminary Report on Patentability dated Jun. 27, 2017 in International Patent Application No. PCT/GB2015/053989, 6 pages.

* cited by examiner

*Primary Examiner* — Anthony D Wiest

(74) *Attorney, Agent, or Firm* — Shook, Hardy & Bacon LLP

(57) ABSTRACT

A security device comprising: a plate (20) having an upper portion (21) and a lower portion (22), wherein the upper portion and the lower portion are parallel and off-set; a bulbous barrier (30), wherein the upper portion of the plate and the barrier form a slot (50) therebetween, and the barrier extends in a direction perpendicular to the upper portion of the plane of the plate and away from the slot.

20 Claims, 16 Drawing Sheets

SECURITY DEVICE

CROSS-REFERENCE TO RELATED APPLICATIONS

This application claims priority under 35 U.S.C. § 365 to PCT/GB2015/053989, filed on Dec. 14, 2015, entitled "A Security Device;" British Patent Application No. GB1423186.4, filed Dec. 24, 2014, entitled "A Security Device;" British Patent Application No. GB1504249.2, filed Mar. 13, 2015, entitled "A Security Device;" and British Patent Application No. GB1509311.5, filed May 29, 2015, entitled "A Security Device." The entirety of the aforementioned applications is incorporated by reference herein.

BACKGROUND TO THE INVENTION

The invention relates to a security device and in particular concerns a device for improving the security of a ship.

In recent years there have been several examples of commercial cargo ships being boarded by pirates. This type of event can present a serious threat to the wellbeing of the crew of the ship, as well as being commercially damaging.

It has been proposed to provide security barriers which can be placed over the rails of a ship to make it more difficult to board the ship. One example of this type of barrier is disclosed in WO2013/072704, Stevens. Removable bulwarks are attached to the peripheral edges of a ship, such as a ship's rail. The bulwarks have a skirt section which is substantially parallel with the ship's wall or railing, and a rear wall. The bulwarks have a smooth and substantially continuous outer surface that provides an overhang which projects outwardly from the ship's rail. Another barrier of this type is disclosed in GB1404192.5, McGarian. A security barrier may be attached to a ship's rail. The device has a barrier element and a support element. The barrier element has a bulbous shape which provides an overhang, when the device is attached to a ship's rail. The barrier element is attached to the support element, with the rail between the support element and the barrier element.

One aim of the devices is to provide a smooth surface, so that hooks and ropes may not be attached to the side of the ship, thereby enabling pirates to climb up the side of the ship and board the ship. Another aim is to provide an overhang that is difficult to traverse, therefore even if the pirates are able to find a way to attach a ladder or rope to climb the side of a ship, they may be prevented from boarding the ship by the overhang.

It is an object of the present invention to provide an improved security barrier of this type.

SUMMARY OF THE INVENTION

Aspects of the invention are set out in the accompanying claims.

A security device according to one aspect of the invention comprises: a plate having an upper portion and a lower portion, wherein the upper portion and the lower portion are parallel and off-set; a bulbous barrier, wherein the upper portion of the plate and the barrier form a slot therebetween; and the barrier extends in a direction perpendicular to the plane of the upper portion of the plate and away from the slot.

A security device according to another aspect of the invention comprises: a plate having an upper portion and a lower portion; a bulbous barrier having a bottom edge, wherein the upper portion of the plate and the barrier form a slot therebetween; the barrier extends in a horizontal direction perpendicular to the plane of the plate and away from the slot; and the lower portion of the plate extends below the upper portion of the plate and the bottom edge of the barrier.

A security device according to another aspect of the invention comprises: a plate having a top edge and a bottom edge; a bulbous barrier having a top edge and a bottom edge, wherein the plate and the barrier form a slot therebetween; the barrier extends in a direction perpendicular to a plane parallel with a upper portion of the plate and away from the slot; the plate has a kink below the barrier so that the upper portion and at least section of a lower portion of the plate are parallel, and the lower portion of the plate is displaced in the same direction as the barrier.

A security device according to another aspect of the invention comprising: a plate having a top edge and a bottom edge, and extending over a first height; and a bulbous barrier having a top edge and a bottom edge, wherein the plate and the barrier form a slot therebetween; and the barrier extends over a second height which is shorter than the first height, and wherein the plate and the barrier are joined together, or integrally formed, at their top edges, and a lower portion of the plate below the bottom edge of the barrier comprises only a single layer of material.

A security device according to another aspect of the invention comprising: a plate having an upper portion and a lower portion; and a barrier having a back section off-set from a bulbous front section and joined to the bulbous front section along a top edge thereof, forming a slot, wherein the back section extends downwardly from the top edge by a first distance; wherein the upper portion of the plate and the back section of the barrier are releasably attachable to each other, wherein when the plate and the barrier are attached, the plate extends downwardly from the top edge by a second distance which is greater than the first distance; and wherein the bulbous front section of the barrier extends in a horizontal direction perpendicular to the plane of the upper portion plate and away from the slot.

Advantageously, the device provides a barrier. In use, around at least some of the rails of a ship, the device makes it much harder to gain access to the ship from outboard. The device may have an outer surface that includes a first side of the plate that extends from a bottom edge of the plate to the top of the device, an outer side of the barrier to the bottom edge of the barrier, and a second side of the lower portion of the plate. The outer surface may be substantially smooth or featureless. This means that there are no footholds or places where a hook or ladder could be attached.

The barrier need not extend the length of the device, thereby reducing the amount of materials needed to make the device and the weight of the device.

The device may usefully be made from a light weight and durable material. For example, the device may be moulded from plastic using a rotational moulding method. The material may be readily recyclable, when the device comes to the end of its life, thereby reducing the environmental impact of the device. Or the material may be a bio-plastic.

At least a portion of the barrier between the top edge and the bottom edge may be curved. The device may rest on a rail and the barrier may be arranged to overhang the side of a ship or a wall so that the upper portion of the plate is an inboard portion and the barrier and lower portion of the plate are outboard portions of the device, thus the barrier provides an overhang. The barrier at its widest point may extend at least 700 mm, and preferably more than 750 mm, measured from the slot and the height of the security barrier may be between 0.5 m and 1.5 m, and preferably approximately 1.2 m or 1 m. The barrier extends furthest from the slot, proximate to the top edge. Thus, even if a person outboard of a ship could have a way to attach a ladder to climb the sides of a ship, it would then be difficult to get over the overhang to gain access. Thus, the security of a ship may be improved by using the device.

The plate may include a kink or 'S' bend between the upper portion and the lower portion which provides the off-set. This assists with supporting the device when it is resting on a rail and ensuring that it is secured. The kink may curve around an intermediate rail. The plate has at least one attachment point for securing the device to a rail, preferably located towards the bottom edge of the plate. The device may include attachment tabs which include at least one of the attachment points, preferably wherein the attachment tabs extend from the bottom of the barrier. If the device is in two parts, with separate plate and barrier parts, the plate and barrier may have attachment points for attaching the parts together and or to a rail.

The plate may further comprise an angled portion, proximate to the bottom edge, which angled to extend away from the plane of the upper portion of the plate in the horizontal direction. This allows water to drain from inboard of the device, over the edge of the ship. Or the plate may comprise a hinge, across the lower part of the plate, preferably below the kink, so that the lower part of the plate may swing to provide an opening at the bottom of the device.

The device may have substantially uniform cross section taken in a vertical plane, perpendicular to the plane of the plate. Thus, two or more devices may be placed in close proximity or next to each other to form a substantially continuous barrier along the rail.

Other aspects of the invention will become apparent from the following description.

BRIEF DESCRIPTION OF THE FIGURES

In order that the present invention may be more readily understood, embodiments thereof will now be described, by way of example, with reference to the accompanied drawings, in which.

DETAILED DESCRIPTION OF THE INVENTION

The invention relates to a security device. In overview, the security device has an inboard portion and a bulbous outboard portion to provide an overhang. A number of devices may be secured to the rails or walls of a ship, around the periphery or edge, to make it more difficult to gain access to the ship's deck. Typically rails have a height of 1 m and intermediate rails are spaced apart by a maximum of 38 cm. The bottom rail is typically less than 23 cm from the ship's deck. Typically, rail support stanchions are spaced 1.5 m apart.

In the specification terms such as 'top', 'bottom', 'side', 'front', 'back', 'height', 'width' and 'depth' are used. Terms such as 'inboard' and 'outboard' refer to the components relative to their position to the wall of a ship. It should be understood that these refer to the components when they are installed in the manner described and depicted herein, and not in any other orientation.

Figure 1:
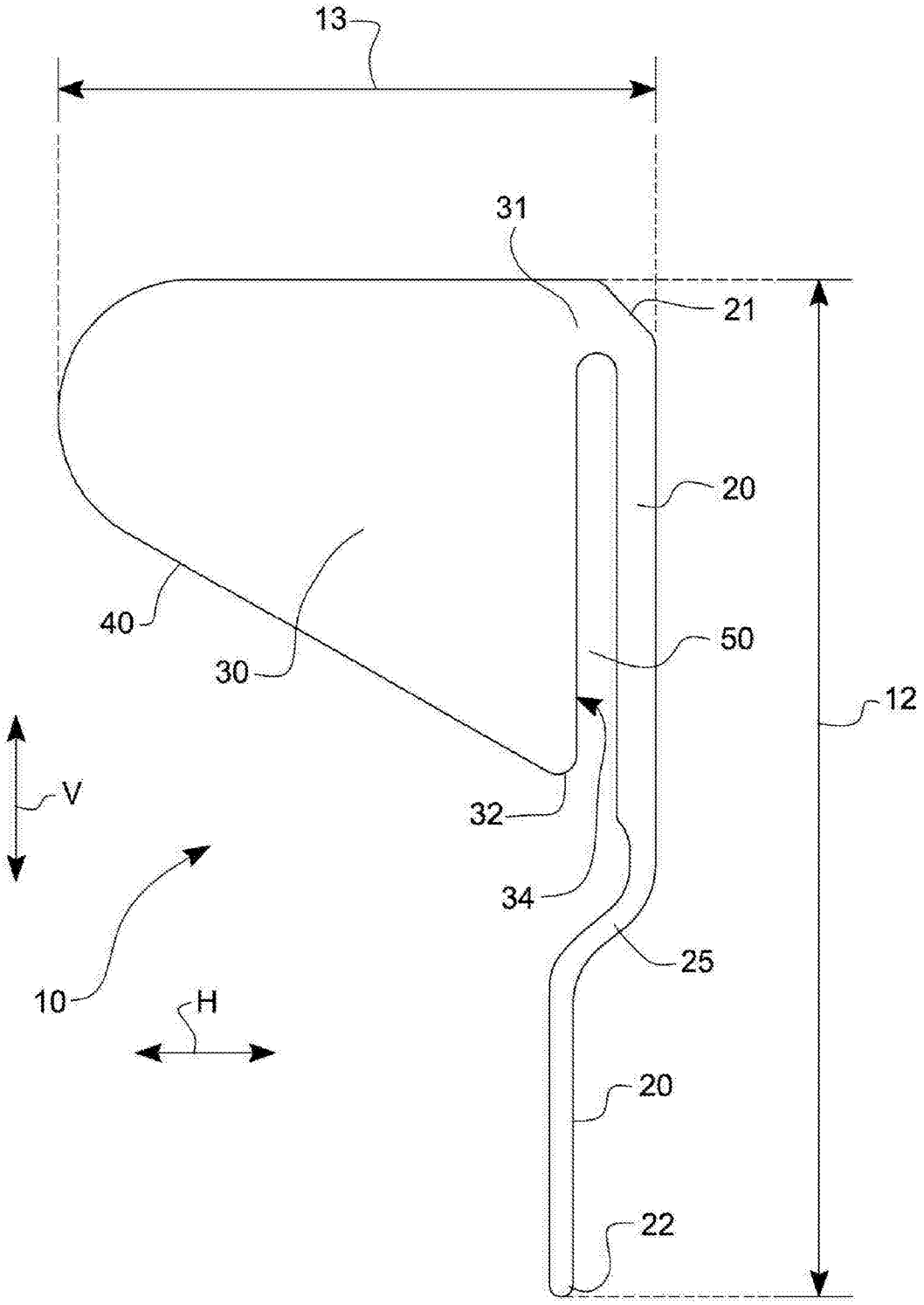
FIG. 1 illustrates a plane side view of a security device.
Figure 2:
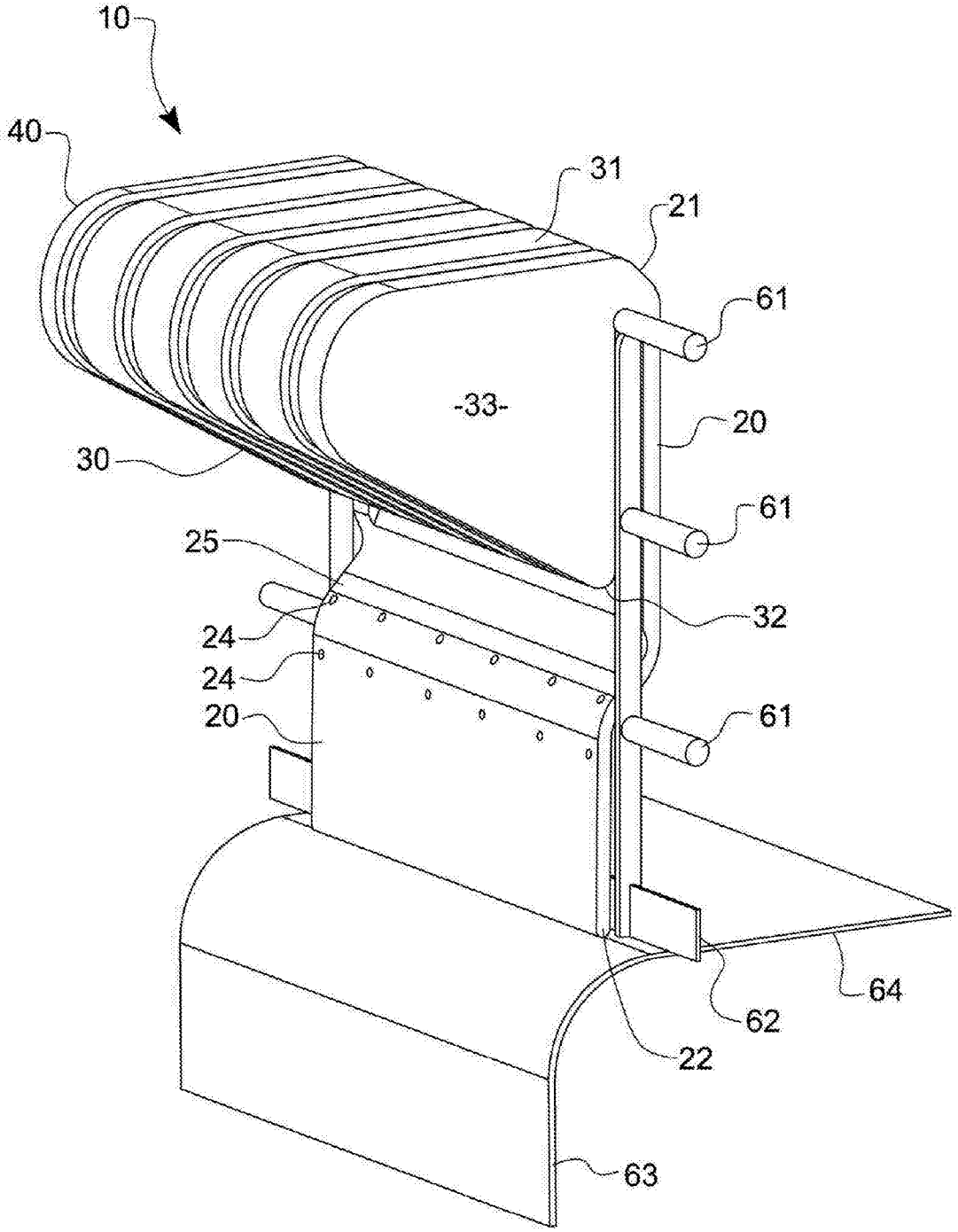
FIG. 2 illustrates a side-front perspective view of a security device.

FIGS. 1 and 2 illustrate a first embodiment of the invention. FIGS. 3 to 6 illustrate an alternative embodiment of the invention. FIGS. 7 to 13 illustrate additional and/or alternative features which are within the scope of the invention.

FIG. 1 illustrates a side plane view of a security device 10 according to one embodiment of the invention. To the side of the illustration the vertical direction V, and the horizontal direction H are indicated. The security device 10 has height or length 12 in the vertical direction V and depth 13 in the horizontal direction H.

The device 10 consists of two main parts: a plate 20, shown vertically in FIG. 1, and a barrier 30. The plate has a top edge 21 bottom edge 22. Between the top edge 21 and the bottom edge 22 there is a kink 25 in the plate 20. A top portion of the plate 20 is above the kink 25 and a bottom portion of the plate is below the kink 25. At the kink 25, the plate goes through an 'S'-bend or similar so that the bottom portion of the plate is horizontally displaced or off-set from the top portion of the plate. The top portion and bottom portions of the plate are substantially parallel. The kink or 'S' bend 25 is suitably sized so that, in use, the device 10 may rest on the rail of a ship and the kink 25 bends around an intermediate rail, discussed in more detail below.

The barrier has top edge 31, bottom edge 32, sides 33 and an inner face 34. The barrier 30 and the plate 20 are connected along the top edges 21, 31 and the top edges 21, 31 are preferably integral so that there is no interface between the plate 20 and the barrier 30. In an alternative arrangement, illustrated in FIGS. 10*a* to 10*c*, the barrier 30 and the plate 20 are separate pieces, i.e. the device 10 is modular. Other modular arrangements are described below. The barrier 30 has a back section 39 which provides a slot 50 between the inboard portion and the outboard portion of the barrier 30. The upper portion of the plate 20 has a complementary shape compared with the back section 39 of the barrier 30. The plate 20 and back section 39 also have corresponding attachment points 24. Thus, in the alternative arrangement, the security device 10 is in two parts that may fit together to have a similar arrangement to the other security devices 10 described herein.

An outer surface 40 of the device 10 extends from the bottom edge 22 of the plate 20, over the top of the device 10, and down to the bottom edge 32 of the barrier 30. The outer surface 40 then continues below the bottom edge 32 of the barrier 30 with a second side of the lower portion of the plate 20. The outer surface 40 is substantially continuous and featureless except for the gap between the bottom edge 32 of the barrier 30 and the lower portion of the plate 20, or at the join between the barrier 30 and the plate 20, in the alternative arrangement illustrated in FIGS. 10*a*, 10*b* and 10*c*.

As can be seen in FIG. 1, from the top edge 21 of the plate 20, the barrier 30 extends horizontally outwardly, perpendicular to the plane of the plate 20. The barrier 30 extends from the plate 20 furthest, to depth at a maximum 13 proximate to the top edge 21, 31 and tapers towards the bottom edge 32. The outer surface 40 meets the inner face 34 at the bottom edge 32. The lower portion of the plate 20 is off-set in the same direction as the barrier 30.

Between the upper portion of the plate 20 and the barrier 30 there is a slot 50. The slot extends from the bottom edge 32 of the barrier 30 to the top edge 21, 31. The sides of the slot 50 are defined by the upper portion of the plate 20 and the inner face 34 of the barrier 30. The sides of the slot 50 are substantially parallel so that the slot has uniform width in the horizontal direction H. The slot 50 is open at the bottom end and extends vertically towards the top edge 21, 31 where the plate 20 and barrier 30 meet. There is no connection between the plate 20 and the barrier 30 at the bottom of the slot. The slot 50 is suitable for receiving the top portion of a rail of a ship 61. In one embodiment, the device 10 is preferably continuous between the plate 20 and the barrier 30 at the top edge 21, 31 such that there is no interface between the parts at the top. The slot 50 provides a gap of approximately 5 cm and has a length of approximately 50 cm.

As will be familiar to the skilled person, the deck of a ship typically has railings near its outer edge, comprising a top rail and at least one intermediate rail. These are raised above the surface of the deck. The decks of many ships also include a short upstanding kick board which runs around the perimeter of the deck, at or near the edge thereof, substantially directly beneath the top rail. The kick board performs the function, among others, of preventing dropped objects from rolling off the desk of the ship. On typical vessels the kick board may have a height of 100-150 mm.

The security barrier 10 preferably has a height 12 of around 1-1.3 m, and a width of 1-1.5 m. The top rails provided on cargo ships are typically around 1-1.2 m high, and the security barrier 10 should be formed to be a suitable height 12 to fit onto these rails. A series of security barriers 10 may be provided, adjacent to one another, running along the rail(s) of the ship. Preferably, all rails at the edge of the ship's deck are provided with security barriers. In addition, barriers 10 may be placed on other rails to give an additional layer of protection, for example, on the rails surrounding the entrance to the ship's bridge.

FIG. 2 illustrates a front-side perspective view of a security device 10, in which one side 33 of the barrier 30. The device 10 is resting on a ship's rail 61. The rail 61 has a top rail and two intermediate rails 61. Immediately next to the deck 64 is a kick board 62, in-line with the rail 61. As shown in the drawing, typically the rail 61 is slightly set back from the very edge of the ship. The deck 64 is flat and curves over (in the example shown) to form the side of the ship 63.

The side 33 is a panel which is approximately triangular, with a rounded point at the bottom edge 32 of the barrier 30 and one side forming the inner face 34.

Figure 3:
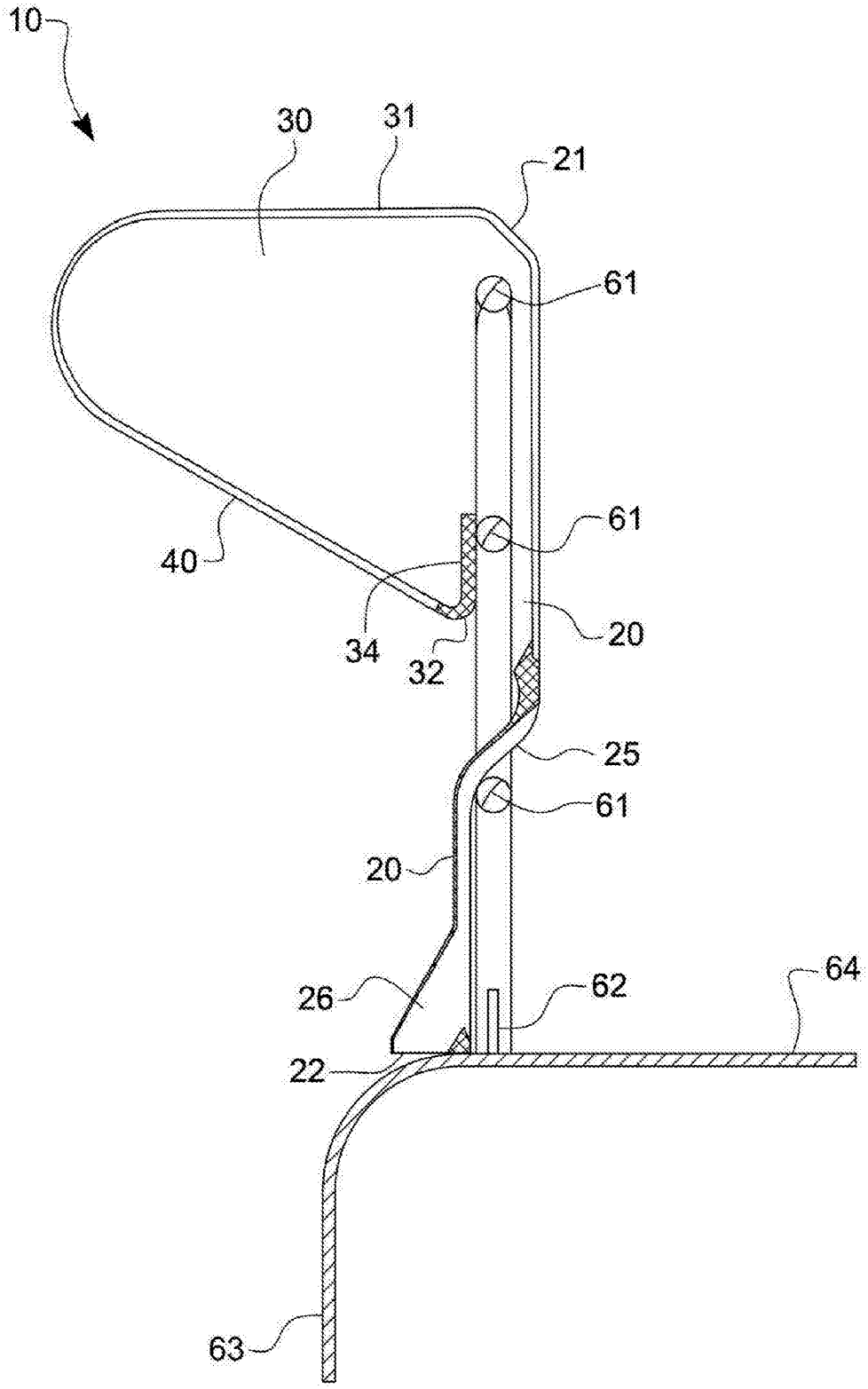
FIG. 3 illustrates a plane side view of a security device.
Figure 4:
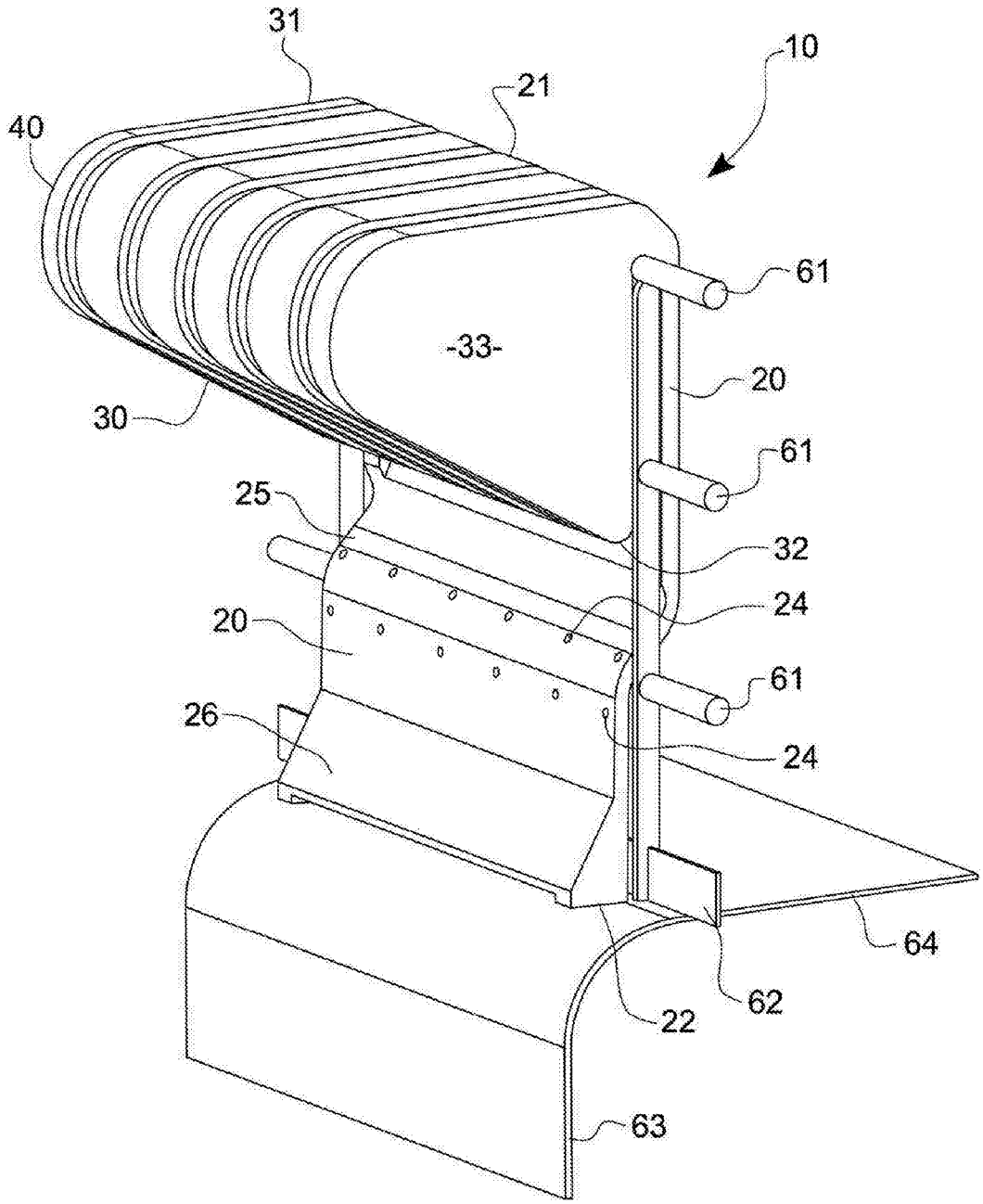
FIG. 4 illustrates a side-front perspective view of a security device.
Figure 5:
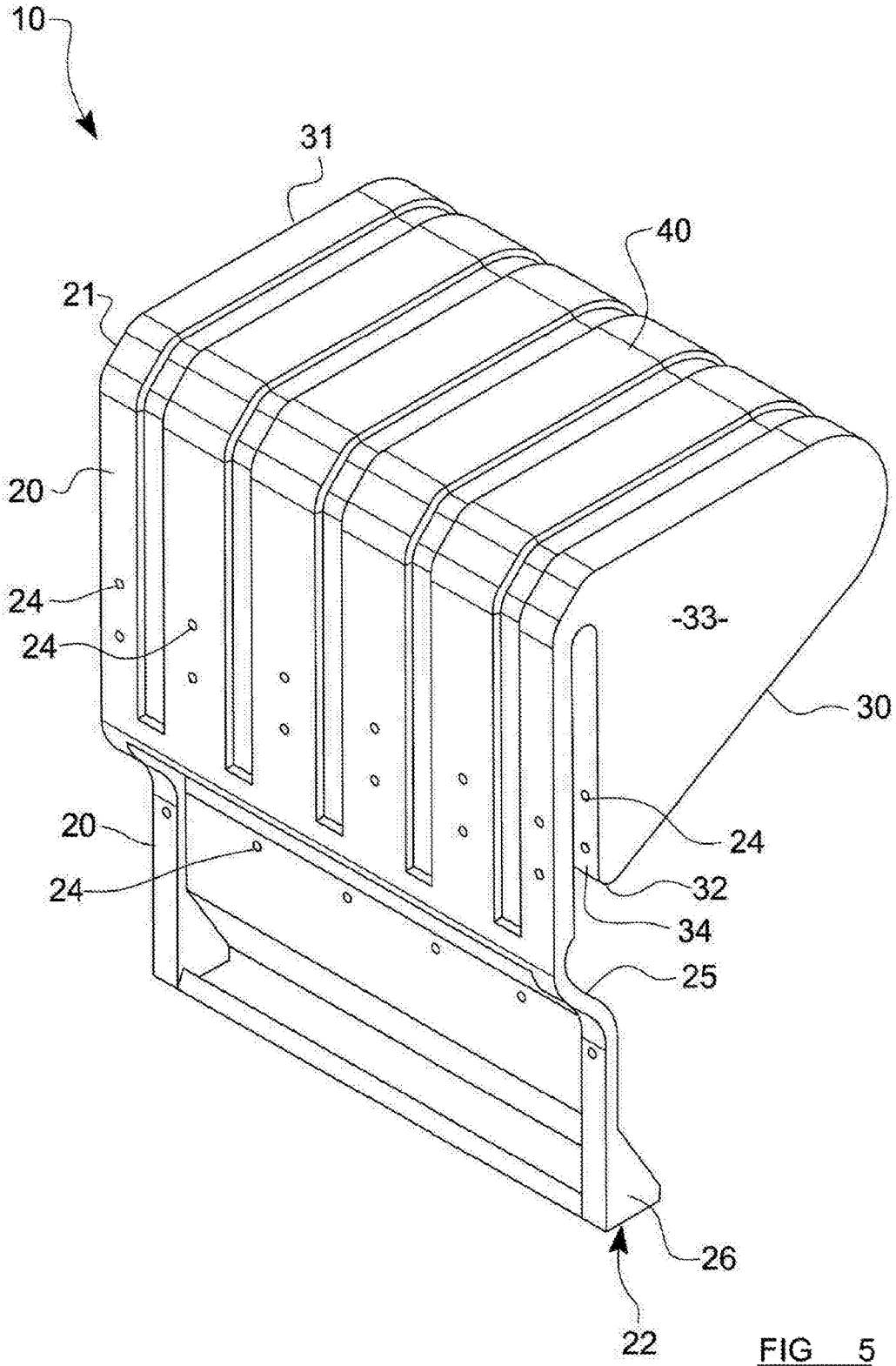
FIG. 5 illustrates a side-back perspective view of a security device.
Figure 7:
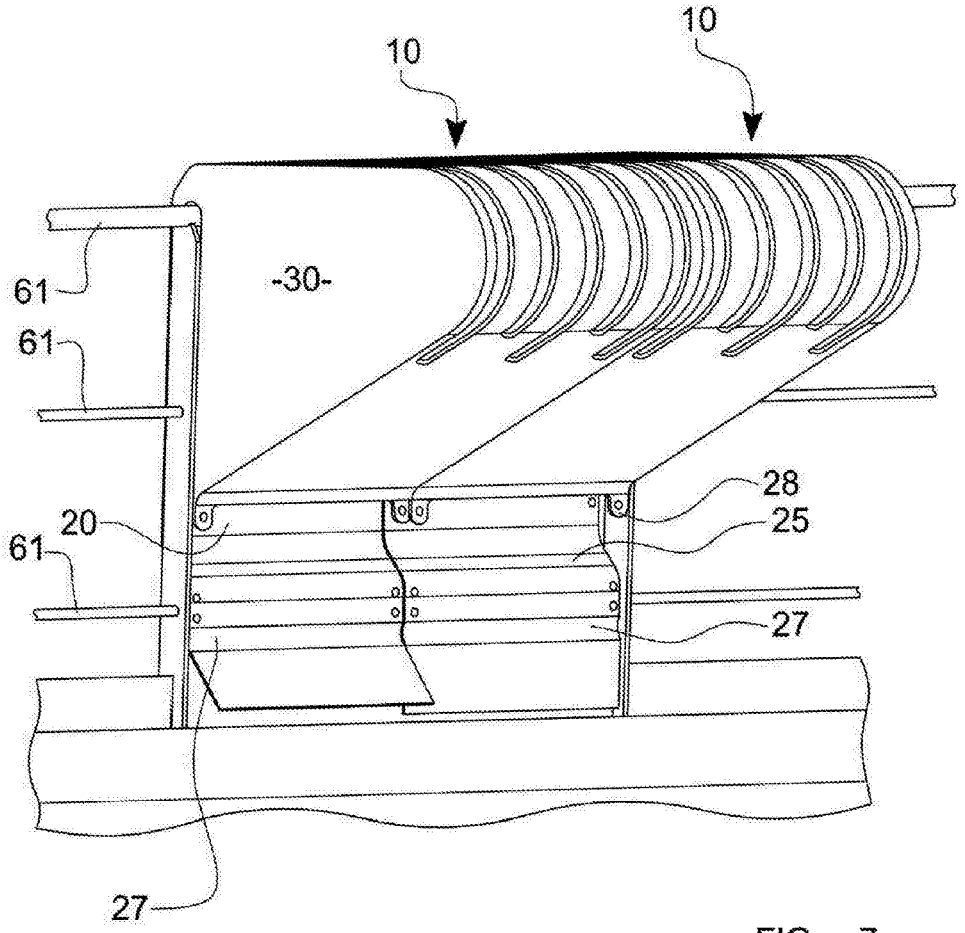
FIG. 7 illustrates a side-front perspective view of two security devices.
Figure 8:
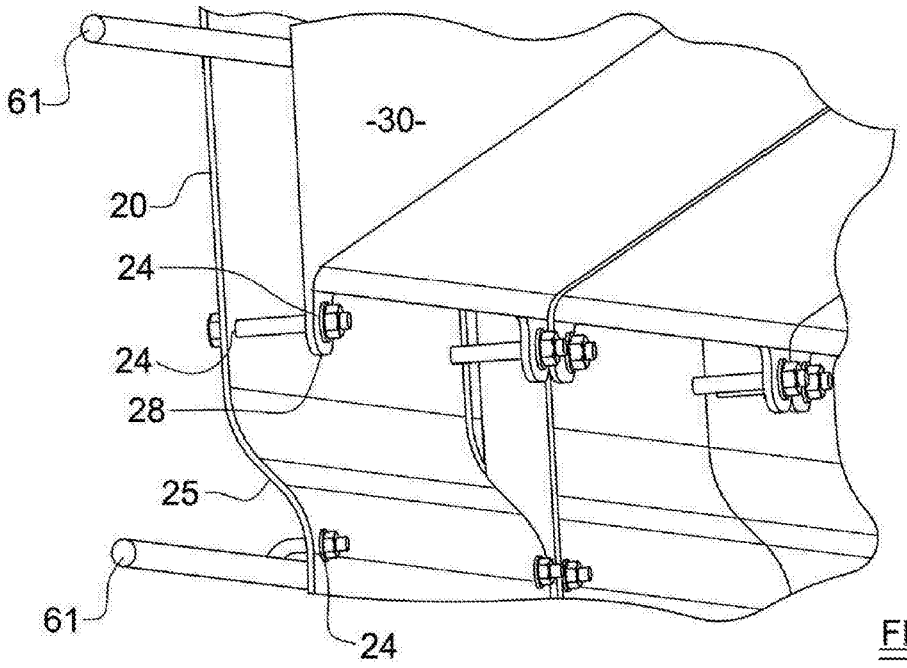
FIG. 8 illustrates a side-front perspective view of a portion of some security devices.
Figure 9:
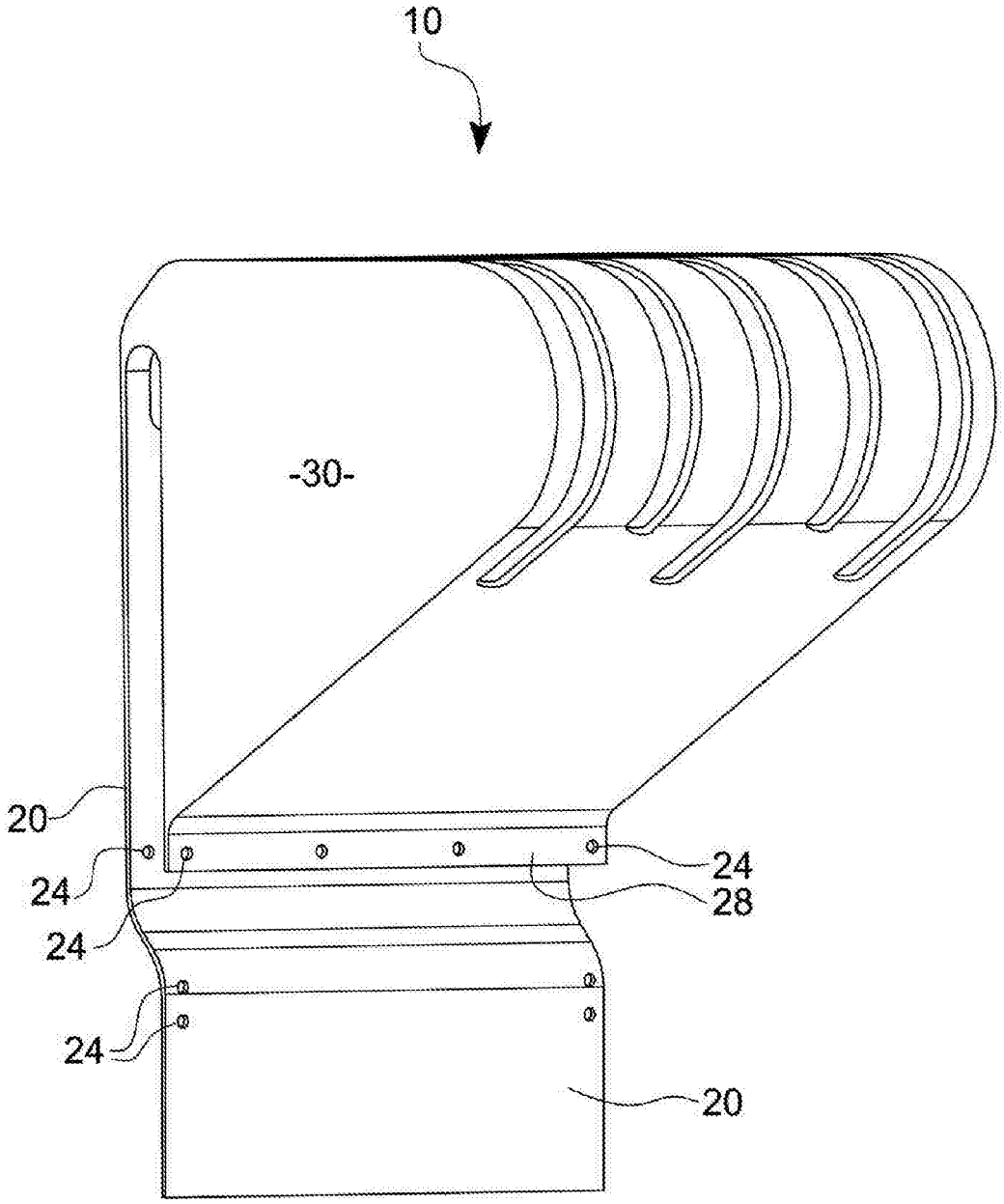
FIG. 9 illustrates a side-front perspective view of a security device.

Parallel and opposite to the first side 33 is a second side 33, which cannot be seen in this figure. Accordingly, the barrier portion of the outer surface 40, the sides 33 and the inner face 34 define the shape and volume of the barrier 30. The inner face 34 may be the entire height of the barrier 30 or the inner face 34 may be a short upstanding wall, as shown in FIG. 3. In an alternative arrangement, the inner face 34 may not be present. As shown in FIG. 5, the inner face 34 may include attachment points 24. In the alternative arrangement, where the inner face 34 may not be present, tabs 28 extend from the lower edge of the barrier 30 which include attachment points 24 (FIGS. 7, 8 and 9). In a preferred embodiment, the tabs are spaced apart and the combined width of the tabs is significantly less than the overall width of the barrier. Alternatively, a single long tab may be provided, as shown in FIG. 9. The attachment points 24 are typically holes that enable fixing of the barrier 30 to the plate 20 and or rail 61 thus, increasing the rigidity and or stability of the device. The barrier 30 has a substantially uniform cross section taken in a vertical plane, perpendicular to the plane to the plate 20. The barrier 30 is substantially hollow. The outer surface 40 of the device 10 extends beyond the edge of the ship 63, providing an outboard overhang in use. Further, the sides 33 of the barrier 30 are substantially featureless. One reason for this is so that opposing sides 33 of two devices 10 may be abutted or placed in close proximity to form a substantially continuous barrier of twice the width 11 of a single device 10. In an alternative arrangement, the sides 33 may have cooperating features so that they may be interlocked.

An embodiment of the security device 10 rests on the top rail 61 and has substantially the same height 12 as the rail 61, so that the rail 61 is covered from the top to the deck 64, including the kick board 62. The plate 20 extends through the rails and assists with supporting and securing the device 10 in position. The device 10 is arranged so that the top portion of the plate 20 is inboard, and bottom portion of the plate 20 and the barrier 30 are outboard, relative to the rail 61 so that all the rails 61 and the kick board 62 are covered. In the alternative arrangement illustrated in FIGS. 10*a*, 10*b* and 10*c*, the back section 39 of the barrier 30 is inboard, also. In the illustration, the 'S' bend 25 is arranged to accommodate the bottom rail 61. The plate 20 further includes attachment points 24 which are located just below the 'S' bend 25 and within the 'S' bend 25. The attachment points 24 are used to secure the security device 10 to the ship's rail 61.

From perspective of FIG. 2, the rail 61, and the kick board 62, can be seen to extend either side of the device 10. From this perspective, it is readily apparent how access to an attachment point for a hook through the device 10 is extremely limited or not possible at all. It will be apparent that positioning a series of barriers abutting or in close proximity along a length of rail will avoid presenting a handhold or securement point to unwanted boarders or pirates who are outboard of the ship. Access to the top and middle rails 61 is prevented by the barrier 30, and access to the bottom rail 61 is prevented by the bottom portion of the plate 20.

As will be apparent from the above, the barrier 30 extends over only a portion of the total height of the device. In preferred embodiments, the height of the barrier 30 is no more than three quarters of the total height of the device. More preferably, the height of the barrier 30 is no more than two thirds of the total height of the device. In yet further embodiments, the height of the barrier 30 is no more than half of the total height of the device.

FIGS. 3 to 6 illustrate another alternative embodiment of the security device 10. The main differences between the embodiment of FIGS. 3 to 6 and the first embodiment of FIGS. 1 and 2 will now be discussed. Like features are referred to with like reference numerals.

In the alternative embodiment, the bottom portion of the plate 20, proximate to the bottom edge 21 includes a section 26 that kicks out or extends at an angle in an outward direction (the same direction as the barrier 30) away from the plane of the slot 50. As may be seen in FIG. 4, the kick portion 26 is suitably sized so that, in use, the kick portion 26 does not extend beyond the side of the ship 63. The front side of the kick section 26 which forms part of the outer surface 40 does not extend to the bottom edge 22 of the plate 20. Instead, there is a small gap which may be approximately a few mm wide. It is preferable that the gap is less than the height of the kick plate 62 of the ship.

FIG. 5 illustrates a back-side perspective view of a device 10. As can be seen clearly in FIG. 5, the bottom of the kick portion 26 side is open. A bar extends between the sides of the device at the bottom edge 22 of the plate 20 to provide stability to the kick section 26. Above the bar the back side of the kick section 26 is open.

Figure 6:
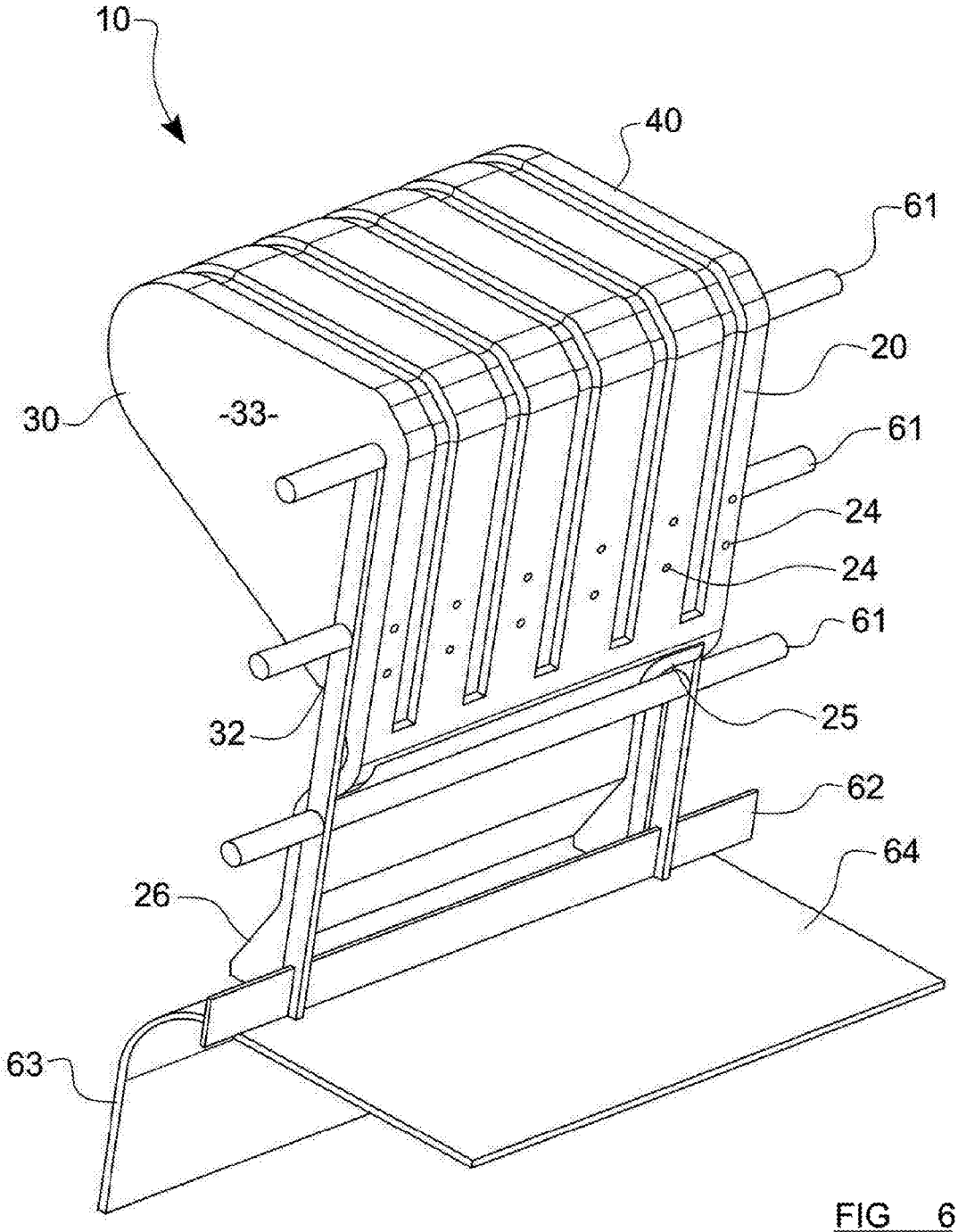
FIG. 6 illustrates a side-back perspective view of a security device.

FIG. 6 illustrates a back-side perspective view of a device 10 in use. As the back of the kick portion is open and there is a gap between the bottom edge 22 and the ship's deck 24, water may wash over the kick board 62 and drain outboard of the ship, through the gap at the bottom edge 22. While such an opening potentially could provide a way through the device 10 to a foothold on the ship, as the gap does not extend a significant distance upwards from the deck 64 and the kick section 26 does not extend beyond the edge of the ship 63, access to the ship is very limited and it would be extremely difficult for a tool or hook to gain access through the gap and hook over the kick board 62.

For any of the embodiments described, the simplicity of the shape of the security device 10 allows the security barrier 10 to be installed in either inboard or outboard facing directions on the rails 61, and without interfering with existing components or equipment of the ship. It would also be possible to install other shaped devices alongside the security devices 10 in order to provide protection to rails which are curved or meet at a corner.

It is not necessary for the device 10 to rest on the top rail 61, when installed. Instead, the device 10 may be supported by the ship's deck 64 and/or by one of more of the rails 61 secured in a vertical position to the rail 61 or another part of the ship. The embodiment illustrated in FIGS. 10*a*, 10*b*, and 10*c* has the barrier 30 separate from the plate 20. The barrier 30 may be suitable for use without the plate 20 on rails 62 which have a lower height. Adding the plate 20 may increase the overall height of the device.

Embodiments of the invention provide a method of arranging the barriers on a ship (or in another setting, such as on an oil rig) where some barriers have the back plate attached and are arranged on relatively high rails or other perimeter features. One or more other barriers do not have a back plate attached, and are positioned on lower rails, walls, or other perimeter features.

It is not necessary for the plate 20 to be arranged with a kink 25 so that it extends through the ship's rails 61. Instead of or in addition to the lower portion of the plate 20, a panel may extend from the bottom edge 32 of the barrier 30. The panel would be suitably sized to extend to the deck 64 of the ship and over the kick plate 62. With this arrangement, the plate 20 need only extend in the vertical direction a big enough distance so that the device 10 can be secured over the rail 61. Therefore, rather than a slot 50 between the barrier 30 and the plate 20 there need only be a gap for receiving the upper rail 61.

In the embodiments described above, the attachment points 24 are a series of small holes through which cable ties or other similar means may be threaded and secured around the railings 61. The attachment points 24 of the device 10 may be used to releasably attach the security device 10 to the ship's rail 61, to secure the security device 10 in position and to prevent the security device 10 from being removed by someone located outboard of the ship. Of course, other suitable attachment means as will be apparent to the skilled person are contemplated by the inventor.

In preferred embodiments of the invention, the barrier 30 is substantially hollow so that it does not take an unnecessary amount of materials to manufacture, nor becomes heavy and difficult to handle. By having a barrier 30 that does not extend, in the vertical direction, the length of the device 10 a smaller amount of material is needed to make the device 10. At least one advantage of this arrangement is that the device 10 is cheaper to make and lighter.

The materials from which the security device 10 is formed may allow the components to flex sufficiently to be robust against any knocks which are likely to occur during use, and transportation. In one arrangement, the lower portion of the plate 20 may be made from a more flexible material so that pressure head from water behind the plate 20 is enough to push the lower portion of the plate 20 out to allow the water to drain over the side of the ship 63, without the need for an opening, as discussed with reference to the second embodiment of the invention. The security device 10 may be made from materials that are readily recyclable at the end of the device's life, in order to reduce the environmental impact. The material may be a regular plastic or a bio-plastic. Alternatively to this, the device, or parts thereof (e.g. the lower part of plate 20), may be made from a mesh with the rest of the device a solid sheet material. In the case where the device is made from a mesh, water could readily pass through the device without the need for specific drainage features.

In an alternative arrangement shown in FIG. 7, the lower portion of the plate 20 may be attached to the upper portion of the plate 20 by a hinge 27 below the 'S'-bend and across the width of the device 10, thereby allowing the lower portion to swing out under pressure head of water behind the plate 20. FIG. 7 illustrates two security devices 10 located side-by-side on a ships rail 61. Both the devices 10 illustrated are of the 'hinge' type. The hinge 27 is located just below the middle rail 61. The device 10 on the right of the illustration has the lower portion of the plate 20 resting parallel with the ship's kick board 62. The device 10 on the left of the illustration has the hinged section at an angle to the kick board 62. The difference between the two devices 10 shows a possible range of movement of the lower portion of the plate 20 below the hinge 27. When water pressure behind the security device 10 is sufficient, the lower portion of the plate 20 below the hinge 27 is pushed out to allow the water to drain.

In the 'hinge' arrangement, it is necessary for at least the hinged lower portion of the device 10 to be suspended slightly above the deck 64 so that the lower portion of the plate 20 may freely swing. Where the device 10 rests or hangs on the top rail 61, the device 10 can be arranged to be slightly shorter than the height of the rail 61 so that the lower end of the device 10 is left dangling. Preferably, the gap between the bottom of the device 10 and the deck 64 would be less than the height of the kick board 62. Alternatively, the device 10 could have its position fixed slightly above the deck 64 by clamping the device 10 to an intermediate rail 61, using the attachment points 24. Another option is to provide at least one 'leg' (not shown in the figures). The leg(s) would extend beyond the bottom of the device 10 and or the lower portion of the plate 20, and the device 10 would rest on the leg, thereby ensuring a small gap between the deck 64 and the bottom of the hinged portion. The leg may comprise a part of the plate immediately above the hinge which extends downwardly on one or both sides of the hinged portion. Where there is more than one leg, they would be suitably spaced apart. Of course, other suitable means for ensuring that the lower portion of the plate 20 may swing freely below the hinge 27 as will be apparent to the skilled person are contemplated by the inventor.

As mentioned above, the outer surface 40 is substantially continuous and featureless. This is not an essential feature, however, it is preferred that the outer surface 40 provides no footholds or features which might assist intruders in gaining access beyond the device 10. The device 10 as shown in the figures is provided with reinforcing ribs on the outer surface 40, which may be parallel and run vertically along all or part of the height of the device 10. The ribs may alternatively be formed in diamond or square patterns, or in any other suitable configuration. The ribs may be provided on the outer surface 40 and/or on the inside surface. The ribs should not be considered essential to the invention.

Forming the ribs only on the inside surface may be preferable, as it would allow a smooth and featureless outer surface 40. The depth of the ribs may, for example, be 10-20 mm.

Alternatively, the security device 10 may be provided with one or more reinforcing elements integrally formed therewith, or attached thereto after production. The reinforcing elements may be formed from a different material to the main body of the security device and may, for example, comprise metal (such as steal) strips or inserts.

In preferred embodiments of the invention, the barrier 30 protrudes outwardly from the plate 20 by a distance of or has a depth of at least 700 mm, and preferably more than 750 mm.

It is preferred that the angle of overhang of at least a region of the lower part of the barrier 30 is at least 15° from vertical when the security barrier 10 is positioned on the ship rails 61. In embodiments of the invention the angle of overhang may be 25° or more.

In the embodiments described above, the security device 10 rests on the upper rail of a ship's railings 61. In other embodiments, a security device 10 may be provided that rests on a lower rail, and has a reduced overall height 12. A lower rail may be around 50%-75% of the height of the top rail. For example, the height 12 of the security device 10 may be around 0.5-0.9 m. Security devices of this type may be suitable for vessels (for example, yachts) that are smaller than full-sized cargo ships. Security devices may be reduced in size. Alternatively, the barrier may be used without the plate or with a smaller plate.

For example, the plate 20 may be reduced in size so that instead of a slot between the barrier 30 and the plate 20 in the upper portion of the device 10, the plate 20 merely consists of a short curved section that forms a hook that fits over the top rail 61, as shown in FIGS. 11 to 13. The upper portion of the reduced sized plate 20 may alternatively be described as the back portion 39 of the barrier 30, where instead of forming a slot, the back portion 39 curves to form a hook or downward-facing trough that receives the top rail. The shortened back section 39 has a free end which may face downwards or curve inwards towards the front forming a hook suitable for receiving the top rail 61. In this embodiment, a separate lower plate 20 would extend from the bottom edge 32 of the barrier 30 to cover the lower rails 61. Attachment points 24 would be positioned proximate to the height of a middle rail 61 for securing the device 10 to the rails. Thus, the device 10 may be 'open' on the inboard side of the barrier 30 and would use a minimal amount of materials.

FIGS. 11 to 13 illustrate modular embodiments of the security device 10 with a short back section 39 and a separate plate 20. The barrier 30 is illustrated in FIGS. 11*a* and 11*b*. As can be seen, only a short section extends below the bulbous part of the barrier to the bottom edge 32. The separate plate 20 is illustrated in FIG. 11*c*. The plate comprises a hinge 27 so that the hinged section below may allow water to pass through the security device 10 for drainage. In alternative arrangement, the lower section of plate 20 could be a mesh material and there would be no need for a hinged section. Attachment points 24 are provided at various points approximate to the edges of the plate. Some of the attachments points are elongate so that the exact positioning of the plate 20 may be adjusted relative to the ships rails 61 and the barrier 30. As can be seen in FIG. 11*a*, the barrier 30 also has elongate attachment points 24. The elongate attachment points may be used to correspondingly adjust the overall height of the device 10.

Figure 11A:
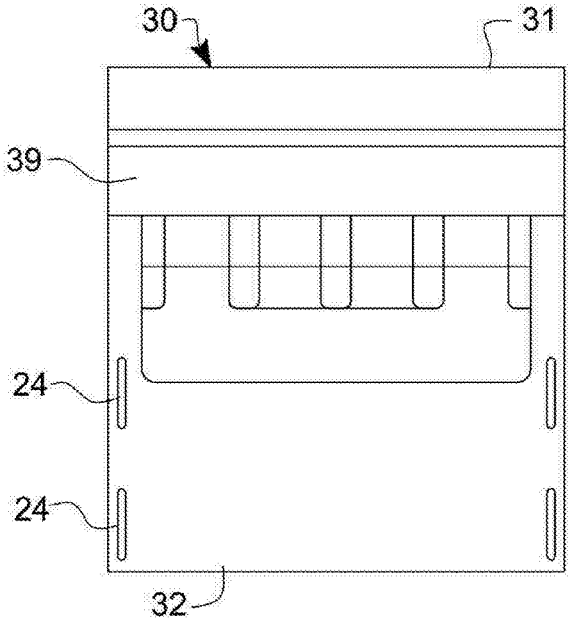
FIG. 11*a* illustrates a back plane view of a barrier.
Figure 11B:
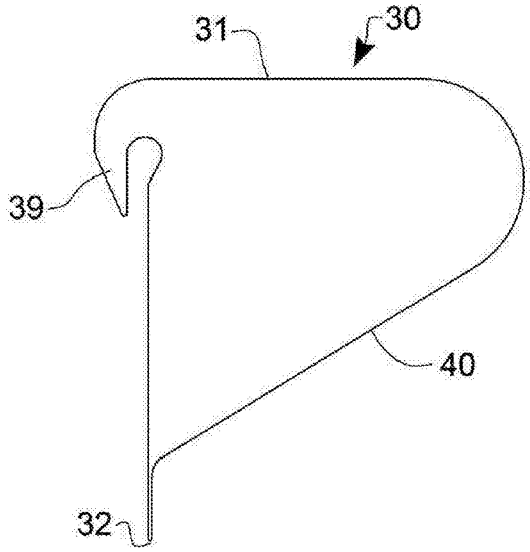
FIG. 11*b* illustrates a side plane view of a barrier.
Figure 11C:
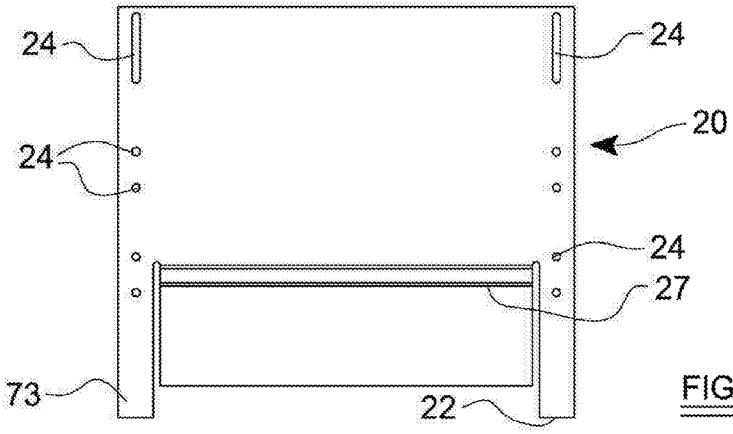
FIG. 11*c* illustrates a front/back plane view of a plate.
Figure 11E:
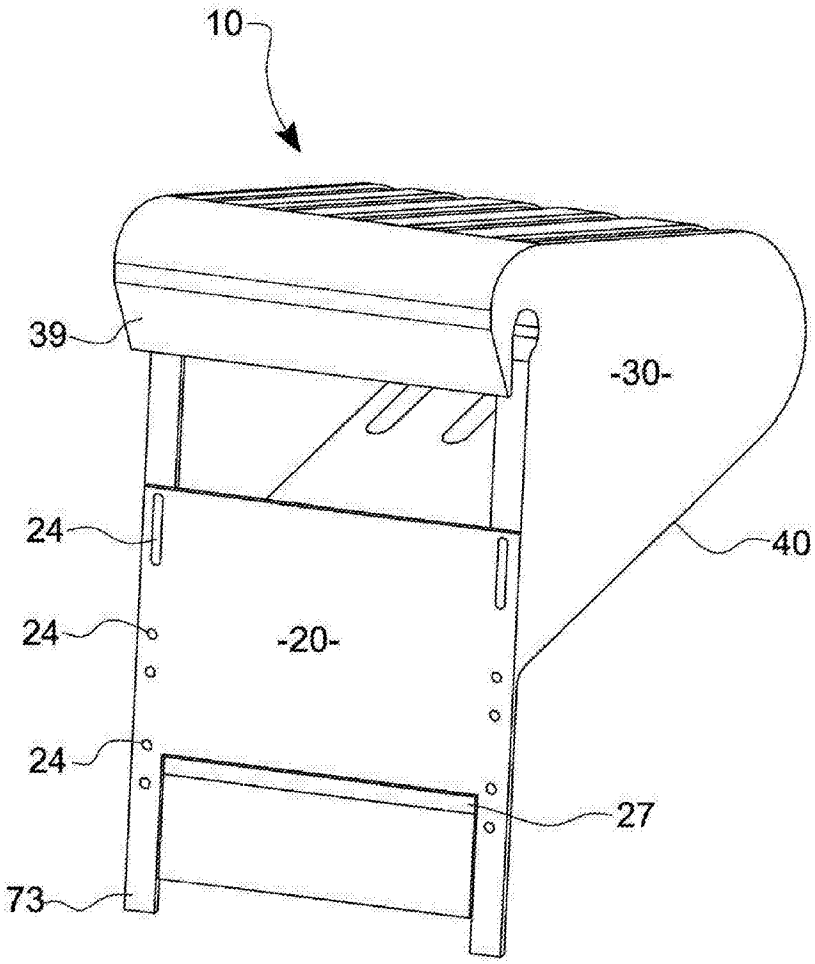
FIG. 11*e* illustrates a side-back perspective view of a security device.
Figure 11D:
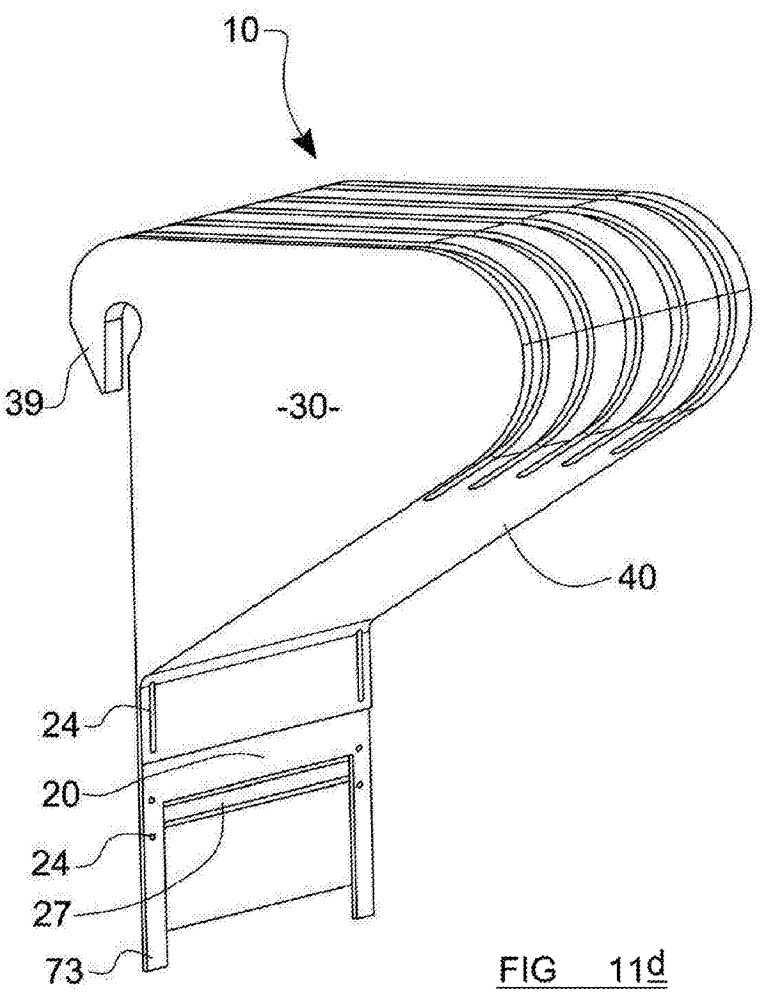
FIG. 11*d* illustrates a side-front perspective view of a security device.

FIGS. 11*d* and 11*e* illustrate a modular security device 10 assembled from a barrier 30 and plate 20 similar to those shown in FIGS. 11*a-c*. The plate 20 is fixed to the barrier 30 on the inboard side of the barrier 30. The plate 20 extends the height of the barrier 30. The overall height of the security device 10 may be adjusted by the relative positioning between the plate 20 and the barrier 30. The elongate attachment points 24 allow for this. Additional attachment points 24 may be used for attaching the security device 10 to a ships rail.

Figure 13A:
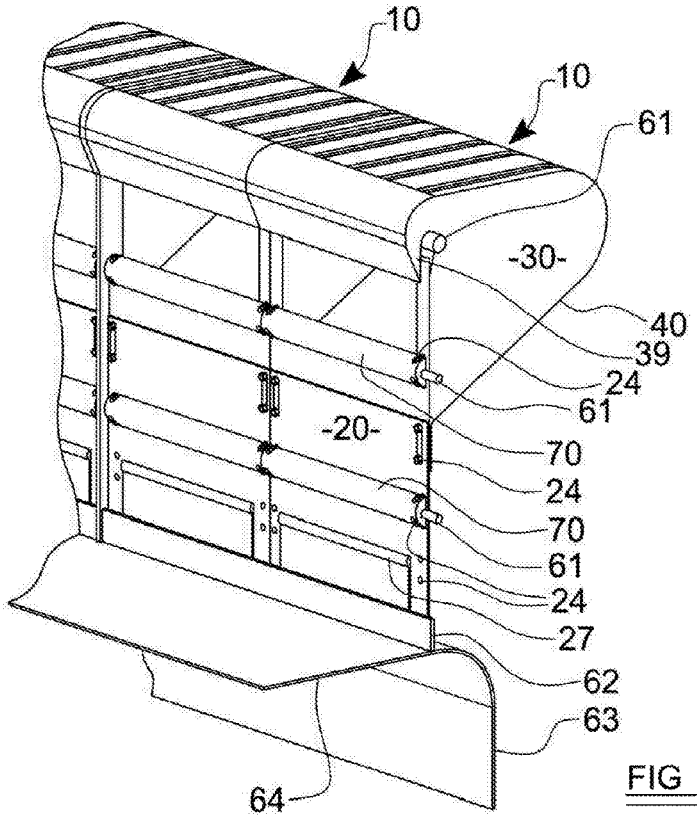
FIG. 13*a* illustrates a side-back perspective view of some security devices.
Figure 13B:
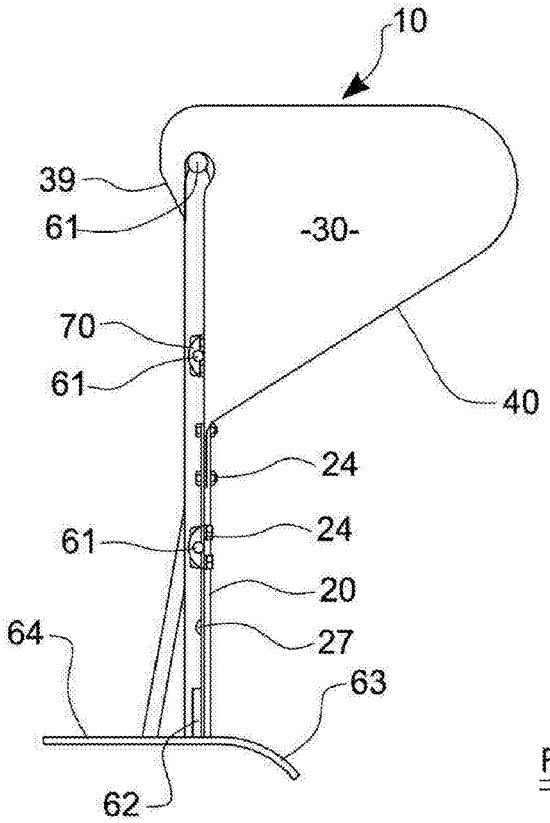
FIG. 13*b* illustrates a side plane view of a security device as shown in FIG. 13*a;*

A series of security devices 10 of the type illustrated in FIGS. 11*a-e* are shown in FIGS. 13*a* and 13*b*. The barrier 30 is hooked over the top rail 61. The plate 20 is fitted so that the bottom edge 22 is approximately level with the ship's deck 64. A rail cover or baton 70 is used on the inboard side of the rail and secured to the plate 20 and or barrier 30.

Figure 12A:
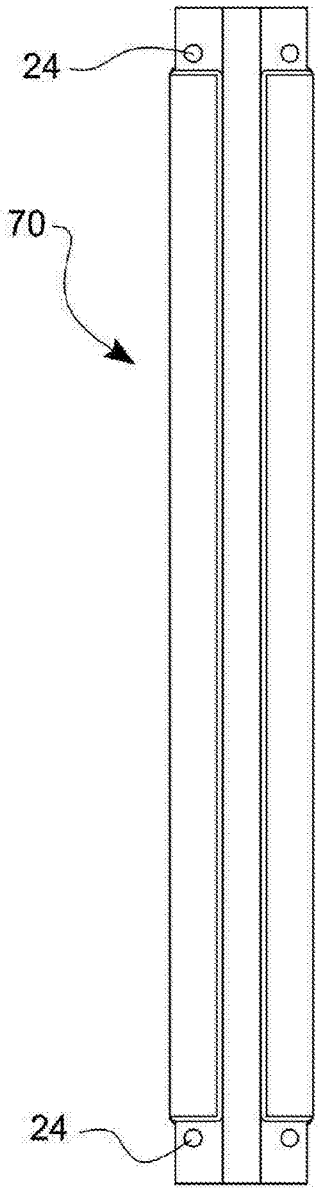
FIG. 12*a* illustrates an outboard side of a baton.
Figure 12B:
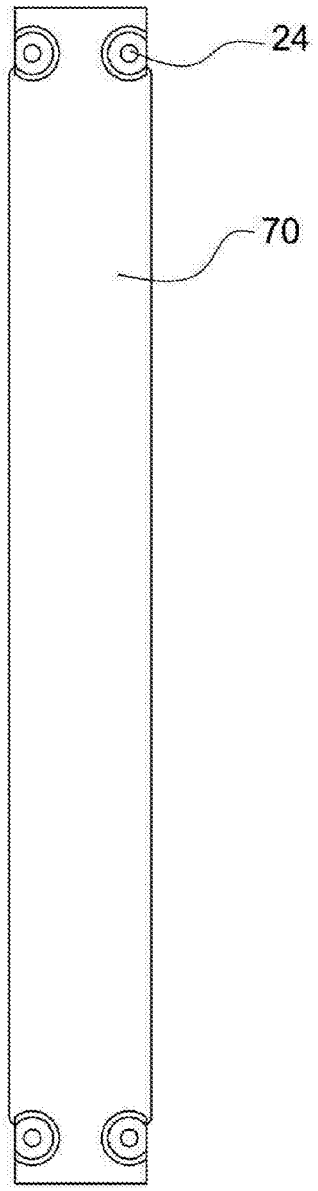
FIG. 12*b* illustrates an inboard side of a baton.
Figure 12C:
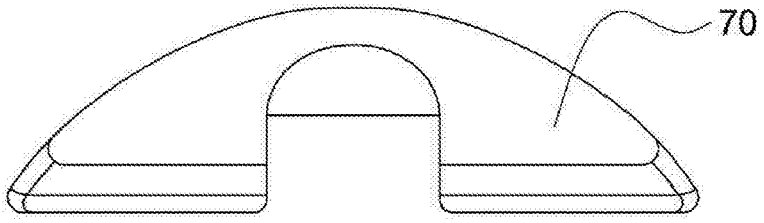
FIG. 12*c* illustrates an end view of a baton

FIG. 12*a* illustrates the outboard side of the baton 70, FIG. 12*b* illustrates the inboard side of the baton 70 and FIG. 12*c* illustrates an end view of the baton 70. The baton 70 has attachment points 24 located towards the ends. The baton 70 has a length of approximately the width of the security device 10 and is shaped to fit over a rail 61 of a ship and be secured to the plate 20 and or barrier 30. The inboard side of the baton 70 has a smoothly curving shape so that even if a grappling hook were to be thrown over the barrier 30, the mid-rail does not provide a feature for the grappling hook to catch on. The outboard side of the baton 70 or the side that abuts the other modules of the security device 10 (the plate 20 or the barrier 30) may be shaped to accommodate features of the rails 61 or the security device 10. For example, the baton 70 may be shaped to accommodate the hinge 27 of the plate 20, where the hinge 27 is positioned proximate to a rail 61.

Figure 14A:
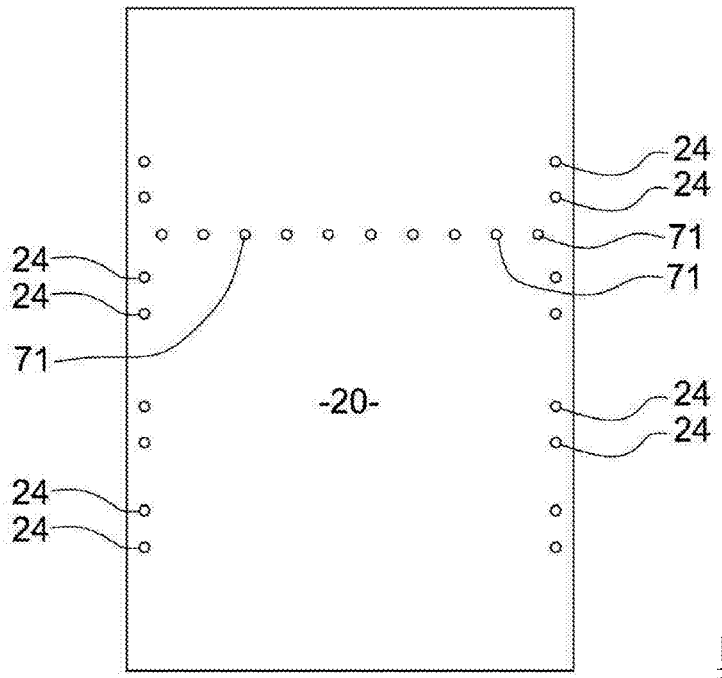
FIGS. 14*a*-14*c* illustrate various plates that may be used with a modular security device.
Figure 14B:
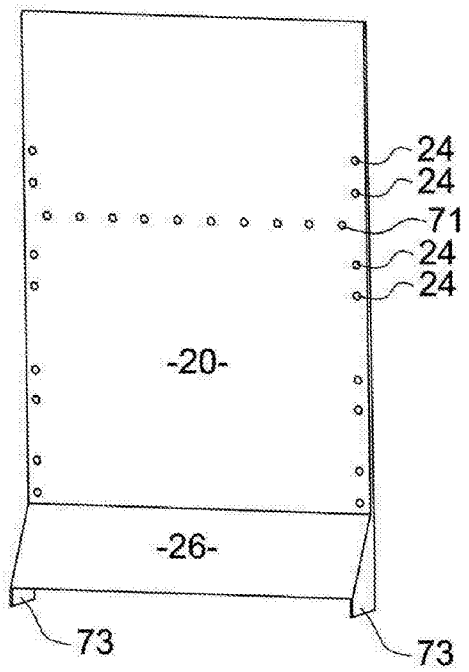
Figure 14C:
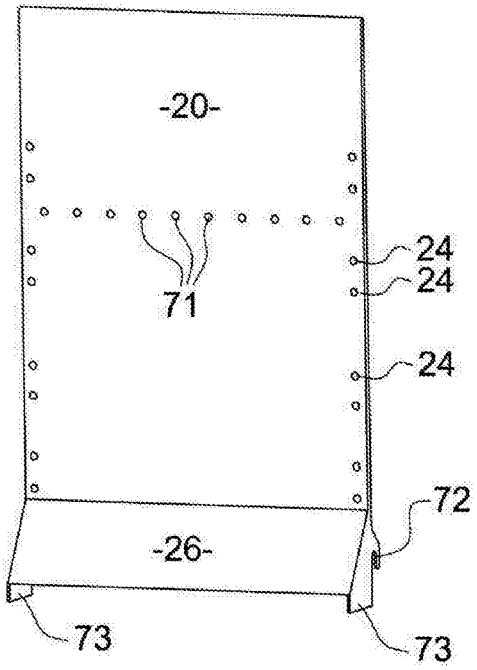

Some alternative modular plates 20 are show in FIGS. 14*a*-14*c*. These may be used interchangeably with suitable barriers 30 and or batons 70.

FIG. 14*a* illustrates a simple flat plate 20. Attachment points 24 are provided at various heights for fixing the plate to a barrier 30 and rail 61. This may be in conjunction with a baton 70 or directly to the barrier 30 and or rail 61. In addition to the attachment points 24, a row of holes 71 is formed across the width of the plate 20. These are intended to align with the bottom of the bulbous D-shape of the barrier 30 and provide drainage of any water that is contained in the barrier 30.

FIG. 14*b* illustrates a plate 20 with a kick portion 26. Feet 73 may be seen to extend from the bottom of the kick portion 26 in order to provide a gap for drainage from inboard of the security device 10 adjacent to the ship deck. Similarly to the plate 20 illustrated in FIG. 14*a*, the plate 20 illustrated in FIG. 14*b* has a series of attachment points 24 and a row of holes 71 to align with the D-shaped portion of the barrier 30.

FIG. 14*c* illustrates another plate 20. This plate 20 has similar features to those shown in FIG. 14*b*. In addition, extending from the inboard side of the plate 20, proximate to the kick portion 26, the plate is provided with downward facing hook like grip feature 72 extending from the side of the kick portion 26. The grip 72 is suitably sized to fit over the ship's kick board 62. This will help to ensure that the security device 10 is located firmly in place with respect to the deck 64.

Figure 15A:
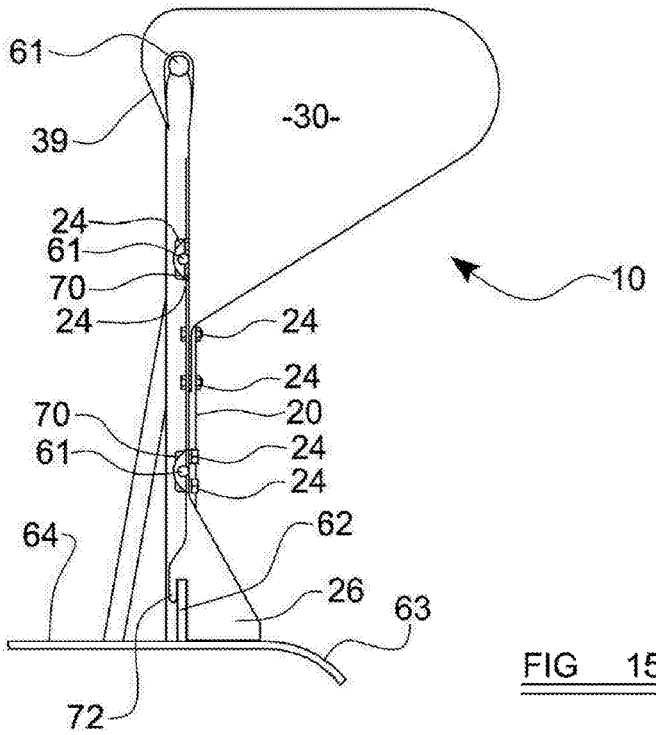
FIGS. 15*a* and 15*b* illustrate an installed modular security device.
Figure 15B:
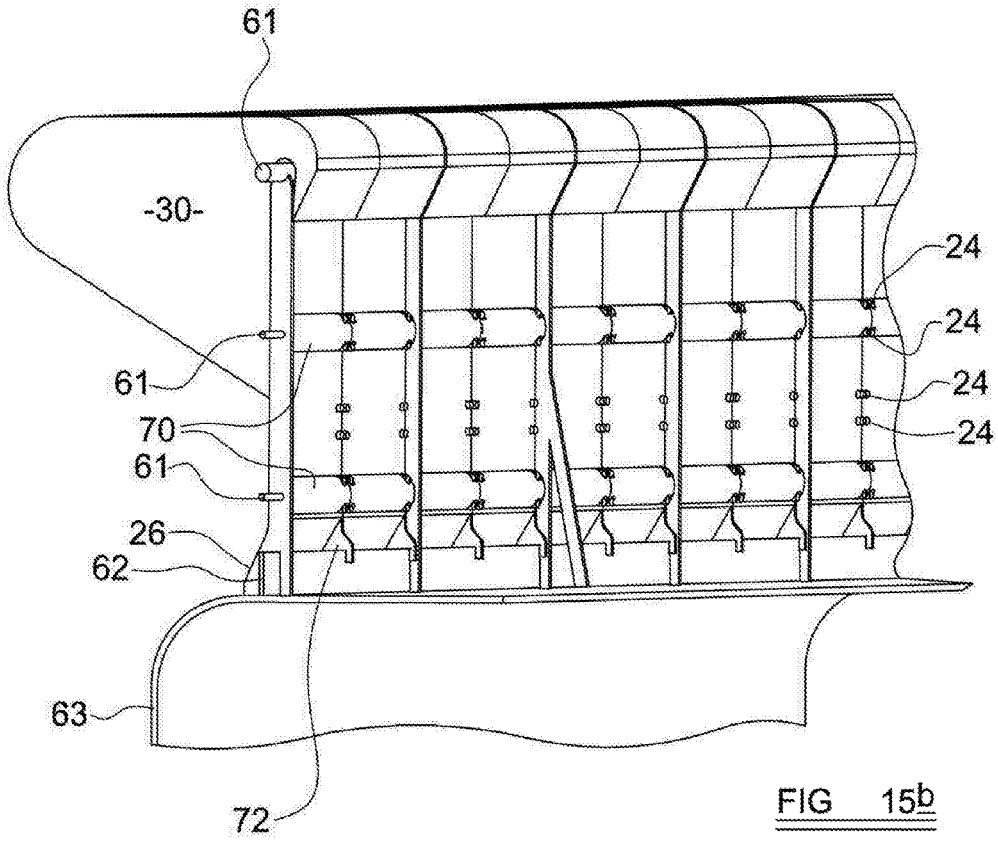

FIGS. 15*a* and 15*b* illustrate an installed modular security device 10 from a side view perspective and a series of installed modular security devices 10 from a back side view perspective respectively. The modular security device 10 illustrated uses a plate 20 of the type illustrated in FIG. 14*c*, batons 70 over the intermediate and lower rails 61 and a hook type barrier 30 of the type illustrated in FIGS. 11*a* and 11*b*. The uppermost attachment points 24 on the plate 20 are used to fix the plate to the intermediate rail 61 and baton 70. The intermediate attachment points 24 are used to fix the plate 20 to the barrier 30. The lowermost attachment points 24 are used to fix the plate 20 to the lowermost rail 61. The kick grip 72 fits neatly over the kick board 62. As can be seen in FIG. 15*b* the plate 20 is of a height to cover the open back/inboard side of the barrier 30. In other arrangements, the height of the plate 20 may be varied so that it does not cover or fully cover the back of the barrier 30.

Figure 10A:
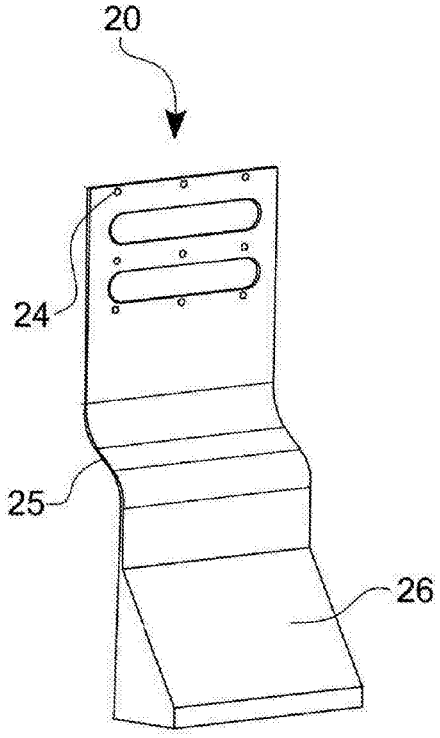
FIG. 10*a* illustrates a side-front perspective view of a plate.
Figure 10B:
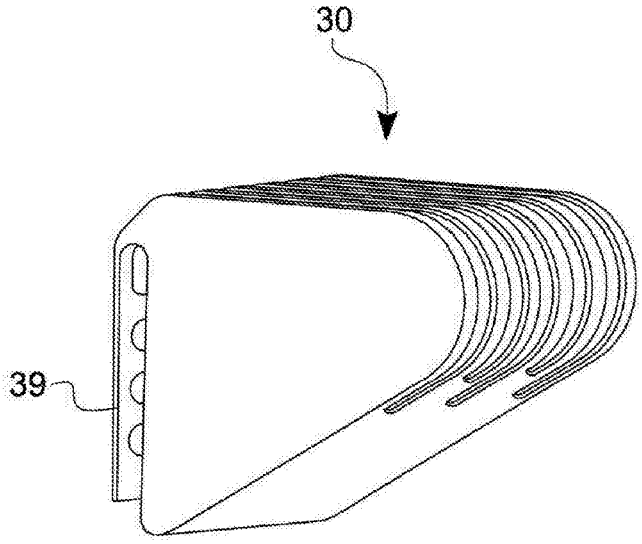
FIG. 10*b* illustrates a side-front perspective view of a barrier.
Figure 10C:
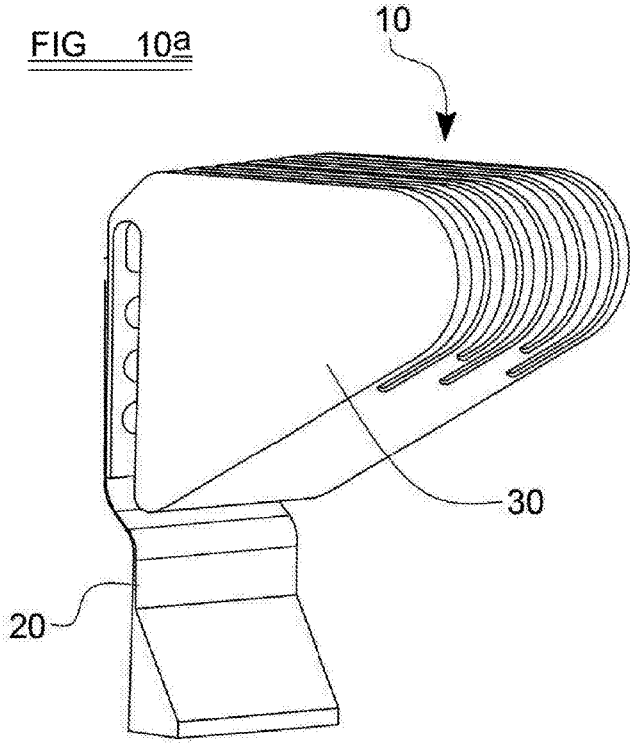
FIG. 10*c* illustrates a side-front perspective view of a security device.
Figure 16:
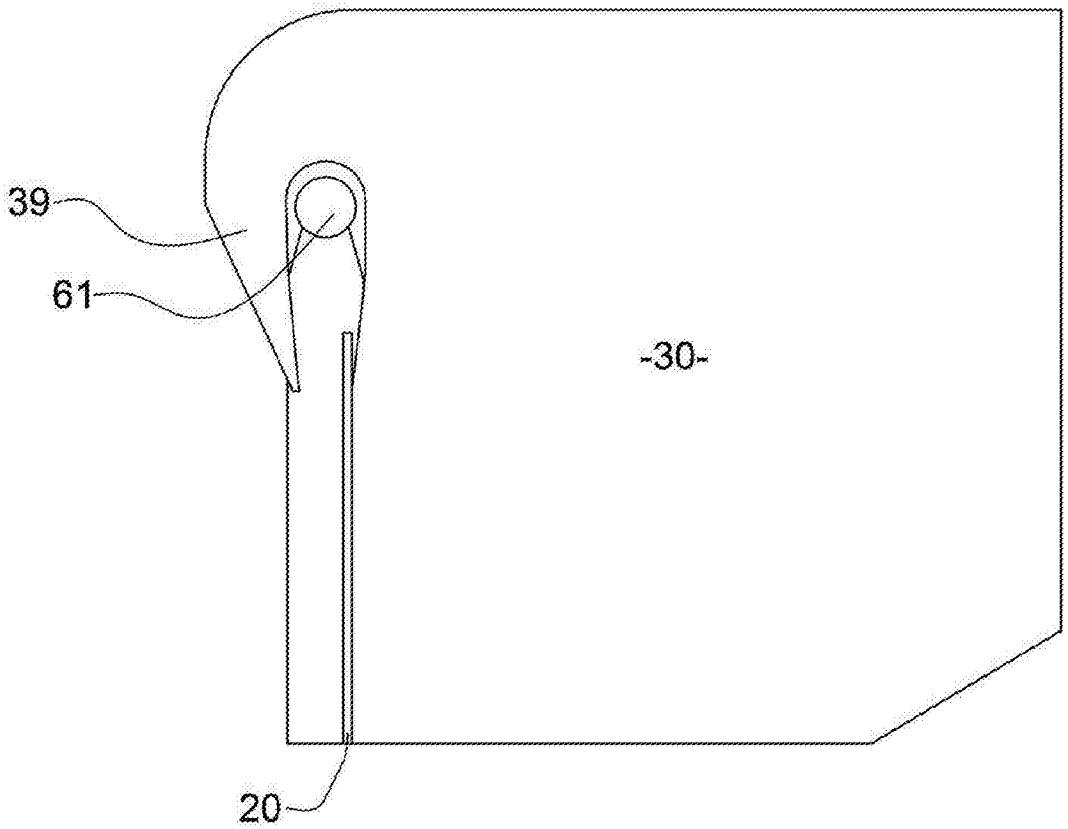
FIG. 16 illustrates a detail of a modular security device.

In the modular system illustrated in FIGS. 10*a* to 10*c*, the plate 20 fits to the inboard side of the barrier 30 to back section 39. In the modular systems illustrated in FIGS. 11 and 13-15 the plates fits outboard relative to the back section 39 but usually (where the height of the plate 20 is sufficient) to the inboard side of the D-shaped portion of the barrier 30. FIG. 16 illustrates the arrangement of a plate 20 outboard relative to the back section 39 and inboard of (and adjacent the rear surface of) the D-shaped portion of the barrier 30.

In an alternative arrangement not shown in the figures, it would be possible to mount a plate 20 to the back section 39 of a barrier 30 of the type illustrated in FIGS. 11*a* and 11*b*, akin to the arrangement of the modular system illustrated in FIGS. 10*a*-10*c*. Of course, the back section 39 and the plate 20 would be modified to provide a good fit for the interface between the back section 39 and the plate 20. Also, it may be necessary to include tabs, similar to the tabs 28 shown in FIGS. 7-9. In this arrangement, the barrier 30 would have attachment points 24 in the short back section 39 and in the tabs 28 to ensure that the plate 20 could be properly secured. For example, one embodiment could have the D-shaped barrier 30 of FIG. 11*b*, with two separate sets of attachment locations 24. Then it would be possible to attach a plate 20 to the barrier either inboard and or outboard relative to the rail, as desired (although not both are needed). The user would be able to select the most suitable plate 20 depending on the situation. In any modular arrangement of the security device 10, suitable attachment points 24 would be provided.

When using a modular system, a similar D-shaped bulbous barrier 30 may be used with a number of different plates 20. This allows the user to select the most suitable plate 20 for the particular situation. The plate 20 may be positioned inboard or outboard (in front of or behind) the back section 39 of the barrier 30.

It will be understood that embodiments of the invention provide effective security devices which will make it difficult or impossible to board a ship equipped with the security devices 10. It will also be understood that the security devices disclosed herein allow the entire height of a ship's rails to be covered, without presenting any point on which a grappling hook or the like may find purchase, while using a minimal amount or material. This is because the lower portion of the device (i.e. the part below the barrier) comprises only a single layer of material. This is in contrast to some prior art arrangements in which the device comprises at least two layers of material over its entire height.

The above description focuses on ships. However, it is also envisaged that the security devices described above may be used with other open water craft such as barges, hovercraft and catamarans. The security devices 10 may also be used in other situations where people may attempt to climb up and over a rail or wall. For instance, the security devices may be used on oil rigs and or other platforms or in prisons.

Certain features of the disclosure are described with reference to certain embodiments and specific figures of the disclosure. It will be apparent that some features are suitable for use with other embodiments and some features are interchangeable.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A security device comprising:

a plate having a top edge and a bottom edge, and extending over a first height; and a bulbous barrier having a top edge, an outer surface, an inner face, and a bottom edge, wherein a vertical slot of substantially uniform width is formed between the plate and the top edge and bottom edge of the barrier and the barrier extends over a second height which is shorter than the first height, and wherein the plate and the barrier are joined at the plate top edge and the barrier top edge, and a lower portion of the plate below the bottom edge of the barrier comprises only a single layer of material.

2. The security device according to claim 1, wherein the device has an outer surface that includes a first side of the plate that extends from the bottom edge of the plate to a top of the device, an outer side of the barrier to the bottom edge of the barrier, and a second side of the lower portion of the plate.

3. The security device according to claim 1, wherein the plate and the barrier are joined by being integrally formed.

4. The security device according to claim 1, wherein the plate further comprises an angled portion, proximate to the bottom edge, which is angled to extend away from a plane of the upper portion of the plate in the horizontal direction.

5. The security device according to claim 1, wherein the plate further comprises a hinge across the lower portion of the plate so that the lower portion of the plate may swing to provide an opening at a bottom of the device.

6. The security device according to claim 1, wherein the slot is suitable for receiving a substantively horizontal rail raised above a surface.

7. The security device according to claim 1, wherein the plate includes a kink between an upper portion and the lower portion which provides an off-set.

8. The security device according to claim 1, wherein the barrier extends furthest from the slot, proximate to the top edge.

9. The security device according to claim 1, wherein the barrier further comprises a back section, spaced apart from a section extending in a horizontal direction perpendicular to a plane to the plate and forming the slot.

10. The security device according to claim 1, wherein, in use, the device rests on a rail and the barrier is arranged to overhang a portion of a ship so that the upper portion of the plate is an inboard portion and the barrier and lower portion of the plate are outboard portions of the device.

11. The security device according to claim 1, wherein the barrier at its widest point extends at least 700mm measured from the slot.

12. The security device according to claim 1, wherein the outer surface is substantially smooth.

13. The security device according to claim 1, wherein at least a portion of the barrier between the top edge and the bottom edge is curved.

14. The security device according to claim 1, wherein the plate is comprised of at least one attachment point for securing the device to a portion of a ship.

15. The security device according to claim 1, wherein the barrier further comprises attachment tabs which include attachment points for securing the barrier to at least the plate or a portion of a ship.

16. The security device according to claim 1, wherein the device has substantially uniform cross section taken in a vertical plane, perpendicular to a plane of the plate.

17. The security device according to claim 1, wherein the plate and the barrier are separate parts for fitting together and the barrier and the plate are attachable.

18. The security device according to claim 1, wherein the plate and barrier may be adjustably positioned relative to each other to correspondingly adjust an overall height of the device.

19. A security device comprising:

a plate having a top edge and a bottom edge;

a bulbous barrier having a top edge and a bottom edge, wherein a vertical slot is formed between the plate and the top edge and bottom edge of the barrier;

the barrier extends in a direction perpendicular to a plane parallel with an upper portion of the plate and away from the slot;

the plate has a kink below the barrier so that the upper portion and at least a section of a lower portion of the plate are parallel, and the lower portion of the plate is displaced in the same direction as the barrier.

20. A security device comprising:

a barrier having a short back section off-set from a bulbous front section and joined to the bulbous front section along a top edge of the bulbous front section and extending downwards, thereby forming a trough that may fit over an upper rail of a ship railing, wherein a depth of the trough is defined by a length of the short back section and the depth of the trough is significantly less than a height of the bulbous barrier;

a lower portion comprising a separate lower plate that extends downwardly from a bottom edge of the bulbous front section to cover a lower rail of the ship railing; and wherein the bulbous front section extends in a horizontal direction perpendicular to a vertical plane of the plate and away from the plane of the plate.

* * * * *